US006196908B1

(12) United States Patent
Adams

(10) Patent No.: US 6,196,908 B1
(45) Date of Patent: Mar. 6, 2001

(54) DRILL FOR COMPOSITE MATERIALS

(75) Inventor: Larry G. Adams, Arvada, CO (US)

(73) Assignee: Storage Technology Corporation, Louisville, CO (US)

( * ) Notice: Subject to any disclaimer, the term of this patent is extended or adjusted under 35 U.S.C. 154(b) by 0 days.

(21) Appl. No.: 09/354,491

(22) Filed: Jul. 16, 1999

(51) Int. Cl.[7] ..... B23B 51/00

(52) U.S. Cl. ..... 451/461; 451/259; 408/145; 408/206; 408/207

(58) Field of Search ..... 451/259, 461; 408/145, 206, 207, 224

(56) References Cited

U.S. PATENT DOCUMENTS 4,582,458 * 4/1986 Korb et al. ..... 408/224
4,720,218 * 1/1988 DeFries et al. ..... 408/145
5,069,584 * 12/1991 Obermeier et al. ..... 408/207 X
5,354,155 10/1994 Adams .
5,427,477 * 6/1995 Weiss ..... 408/224 X
5,466,100 * 11/1995 Ahluwalia ..... 408/224
5,645,617 * 7/1997 Frushour ..... 125/39 X

* cited by examiner

*Primary Examiner*—David A. Scherbel
*Assistant Examiner*—Anthony Ojini
(74) *Attorney, Agent, or Firm*—Brooks & Kushman P.C.

(57) ABSTRACT

A diamond coated drill capable of drilling large holes in composite materials and then reaming the holes to their correct size includes a pair of prongs extending from a shank. Each of the prongs has a tip, a grinder, and a reamer. The tips initiate a hole, the grinders gradually grind the hole to the proper size, and the reamers control the final diameter of the hole. The tips have a coarse grit diamond coating. The grinders also have a coarse grit diamond coating and are axially tapered toward the tips. The reamers have a fine grit diamond coating and are disposed axially above the grinders and the shank of the drill. The grinders apply a radial load to the composite material resulting in no fiber breakout or splintering. The composite material drilled by the drill naturally falls out of the drill during drilling.

13 Claims, 2 Drawing Sheets

DRILL FOR COMPOSITE MATERIALS

TECHNICAL FIELD

The present invention relates generally to drills for drilling holes and, more particularly, to a diamond coated drill for drilling fiber reinforced composite materials.

BACKGROUND ART

In recent years, the use of fiber reinforced composite materials has been steadily increasing in many industries due to its lightweight and strength. As the use of such materials expands, there will be an increased need for a cost effective method of producing high quality holes in such materials with dimensions which are within narrow tolerances.

A number of problems arise in using known drilling and grinding techniques to produce holes in fiber reinforced composite materials. These problems include delamination and splintering of the materials and fiber breakout. Such phenomena are unacceptable in many applications for a number of reasons, including weakening of the structure through which the hole extends. Another reason is that in some applications the rear of the composite material cannot be easily accessed to prevent delamination and splintering or to remove the splintered material. For example, in long length fiber reinforced composite tubes, the inner surface of the tubes cannot be efficiently accessed to prevent fiber breakout or to remove the splintered material.

One conventional solution is to use special drills in combination with some kind of backing support. This approach is typically used with drills that rely on a sharp cutting edge. This is because these types of drills generally delaminate or fray the back side of the composite material as the drill is breaking through unless there is some support that keeps the backside surface in compression. Many cutting edge designs have emerged to eliminate the need for this backing support, but none have succeeded. For some structures, such as small diameter tubes, backing supports are not cost effective or easily used.

Another conventional solution is to implement a computerized numerical controlled (CNC) mill in a two step operation. First, an undersized hole is drilled with a drill that does not cause excessive delamination. Second, the CNC mill enlarges the hole using a diamond coated router. The desired size is achieved using a circle interpolation method. To be cost effective for the production machining of composite tubes, this method requires a large CNC mill to cover the full length of the tube. Even with a large mill, multiple set-ups and a trained machinist are required. Thus, the CNC mill approach is not cost effective for applications such as making repeatable, accurate, and clean holes in fiber reinforced composite tubes.

What is needed is a drill that does not require backing support or a CNC mill. The needed drill cannot cause fraying, splintering, fiber breakout, or delamination.

SUMMARY OF THE INVENTION

Accordingly, it is an object of the present invention to provide a diamond coated drill for drilling a composite material.

It is another object of the present invention to provide a diamond coated drill having a pair of prongs each having a tip for initiating a hole in a composite material, a grinder for grinding the hole, and a reamer for reaming the hole.

It is a further object of the present invention to provide a diamond coated drill having a pair of prongs each having a coarse grit diamond coated tip and grinder and a fine grit diamond coated reamer.

In carrying out the above objects and other objects, the present invention provides a drill for drilling a hole in a composite material. The drill includes a shank and a pair of prongs. The pair of prongs are diametrically opposed from one another and extend axially from the shank. Each of the prongs have a tip for initiating the hole. Each of the prongs further have a grinder disposed axially adjacent to the tip for grinding the hole. Each of the grinders have a tapered cylindrical surface axially tapering toward the tip and grinding means on the tapered cylindrical surface. Each of the prongs further have a reamer disposed axially between the grinder and the shank for finishing the hole. Each of the reamers have a constant diameter cylindrical surface and reaming means on the constant diameter cylindrical surface. The grinding means preferably include coarse grit diamond bonded to the tapered cylindrical surfaces of the grinders and the reamer means preferably include fine grit diamond bonded to the constant diameter cylindrical surfaces of the reamers.

The advantages accruing to the present invention are numerous. For instance, no delamination, fiber breakout, or splintering occurs throughout the process because the fiber reinforced composite material experiences a loading which extends radially from the drill rather than axially. Further, the composite material drilled by the drill naturally falls out of the drill during drilling.

The above objects and other objects, features, and advantages embodiments of the present invention are readily apparent from the following detailed description of the best mode for carrying out the present invention when taken in connection with the accompanying drawings.

BEST MODES FOR CARRYING OUT THE INVENTION

The present invention is a diamond coated drill ("drill", "drill bit", or "bit") capable of drilling large holes and then reaming the holes to the correct size. The drill has a pair of prongs and a shaft. The tips of the prongs have a coarse grit diamond coating which enables them to initiate a hole. The grinders of the prongs are set at a predetermined axial taper with respect to the tips and also have a coarse grit diamond coating for grinding the hole to the proper size. The reamers of the prongs have a fine grit diamond coating for reaming the final diameter of the hole. The drill will not cause delamination, splintering, or fiber breakout throughout the process because the fiber reinforced composite material experiences a loading which extends radially from the drill rather than axially.

The drill of the present invention is discussed below from a number of different perspectives. First, the drill of the present invention is comprised of two separate physical entities: an underlying drill blank and a diamond coating. Second, the drill has a number of sections which extend axially from a mounting shaft to the tips. Lastly, the drill has a number of functional properties, each of which contributes to the creation of a hole in a fiber reinforced composite material without causing delamination or fiber breakout.

Figure 1:
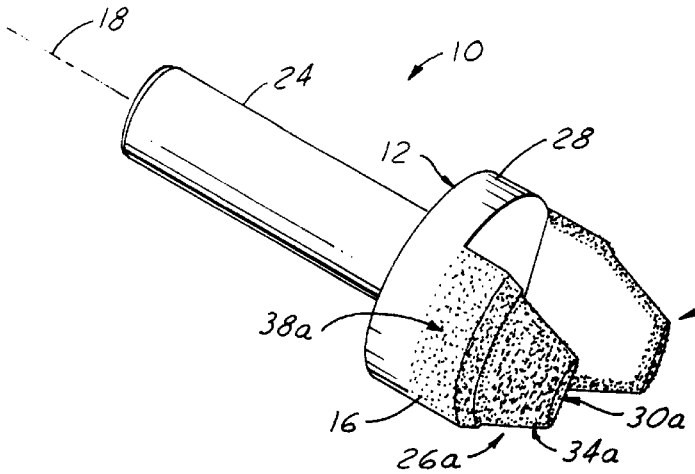
FIG. 1 illustrates a perspective view of a drill in accordance with the present invention.
Figure 2:
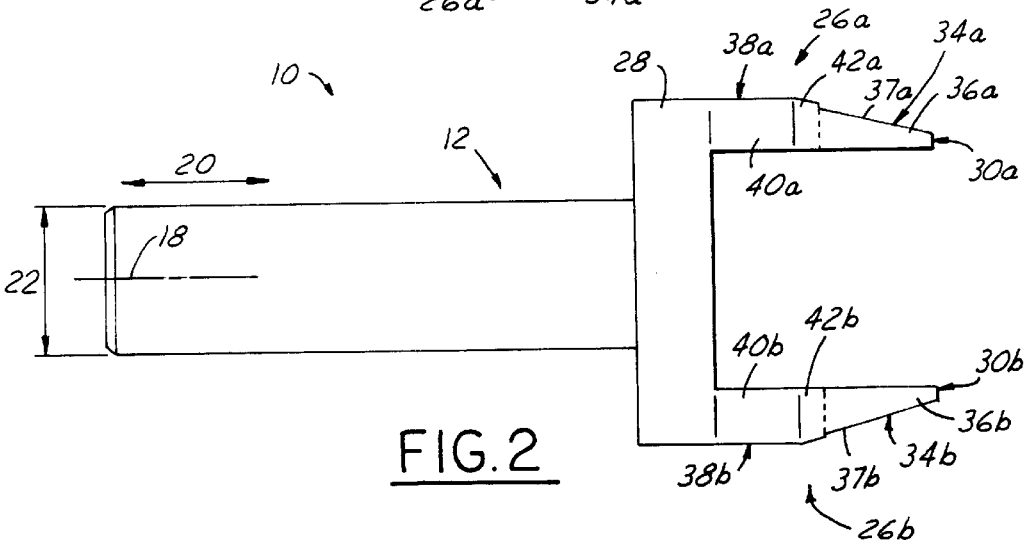
FIG. 2 illustrates a side view of the drill.
Figure 3:
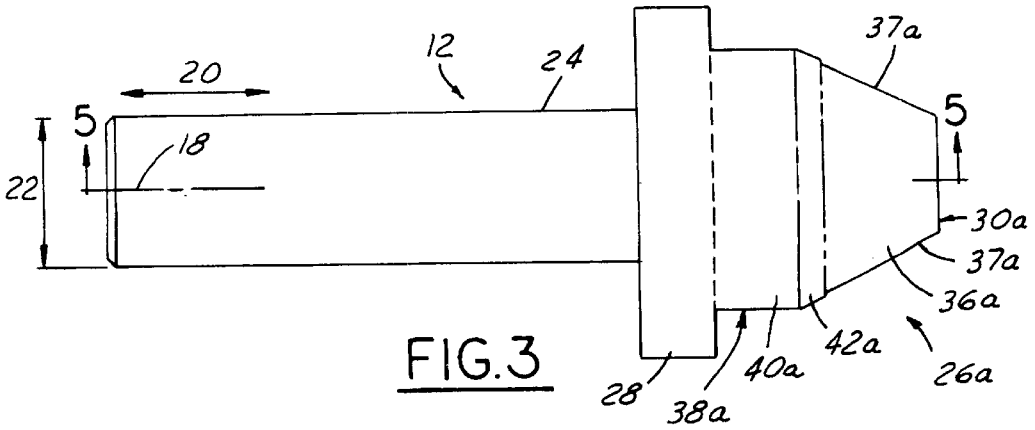
FIG. 3 illustrates a side view of the drill rotated 90° with respect to the side view illustrated in FIG. 2.
Figure 4:
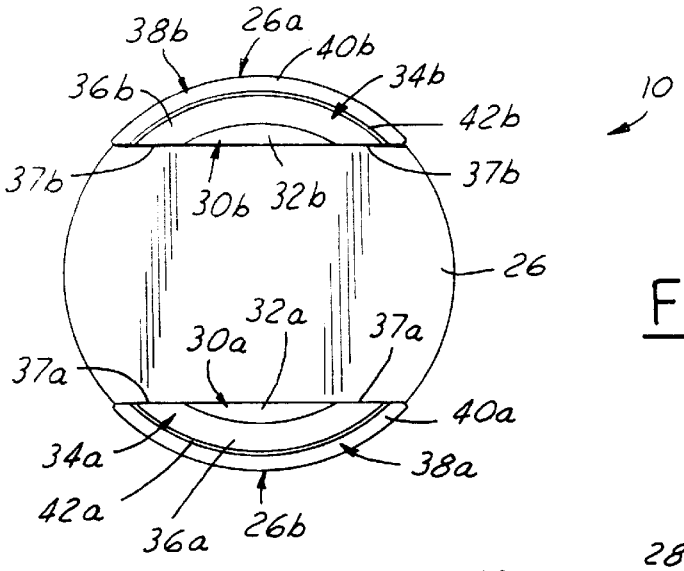
FIG. 4 illustrates a front end view of the drill.

As introduced above, the drill of the present invention has as one of its main components a drill blank upon which the diamond coating is bonded. FIG. 1 illustrates a perspective view of a drill 10 of the present invention. Drill 10 includes a drill blank 12 upon which coarse and fine grit diamond coatings 14 and 16, respectively, are bonded. FIG. 2 illustrates a side view of drill and FIG. 3 illustrates a side view of the drill rotated by 90° with respect to FIG. 2. FIG. 4 illustrates a front end view of drill 10.

Referring to FIGS. 1–4, drill blank 12 ha s a longitudinal axis 18 extending along its length in axial direction 20. Axial direction 20 is orthogonal to radial direction 22. Drill blank 12 includes two main portions: a shank 24 and a pair of prongs 26*a* and 26*b*. Shank 24 and prongs 26*a* and 26*b* are fabricated from a single material such as steel and are bonded together.

Shank 24 includes a constant diameter cylindrical base 28 upon which prongs 26*a* and 26*b* axially extend. Prongs 26*a* and 26*b* are diametrically opposed from one another. Preferably, each of prongs 26*a* and 26*b* has a circumferential length of one quarter of the circumference of cylindrical base 28. Each of prongs 26*a* and 26 include the same structure so only prong 26*a* will be discussed. It is to be understood that identical structure of prong 26*b* is illustrated in the Figures.

Prong 26*a* includes a tip 30*a* for initiating a hole in a composite material. Tip 30*a* includes a semi-elliptical surface 32*a* extending radially from shank 24. Prong 26*a* further includes a grinder 34*a* disposed axially adjacent to tip 30*a* for grinding the hole to the proper size. Grinder 34*a* has a tapered cylindrical surface 36*a* axially tapering toward tip 30*a*. Tapered cylindrical surface 36*a* includes a pair of sides 37*a* which radially increase from a minimum circumferential length of about one sixth of the circumference of cylindrical base 28 at tip 30*a* to a circumferential length of nearly one quarter of the circumference of the cylindrical base.

Prong 26*a* further includes a reamer 38*a* disposed axially between cylindrical base 28 and grinder 34*a* for reaming the hole to the final diameter. Reamer 38*a* has a constant diameter cylindrical surface 40*a*. Constant diameter cylindrical surface 40*a* has a diameter substantially equal to the diameter of cylindrical base 28, i.e., substantially one quarter of the circumference of cylindrical base 28.

Prong 26*a* further includes a tapered cylindrical transition step 42*a* connecting tapered cylindrical surface 36*a* of grinder 34*a* to constant diameter cylindrical surface 40*a* of reamer 38*a*. Transition step 42*a* provides a step less change between grinder 34*a* and reamer 38*a* as will be discussed in greater detail below. Transition step 42*a* axially tapers from reamer 38*a* to grinder 34*a*.

Figure 5:
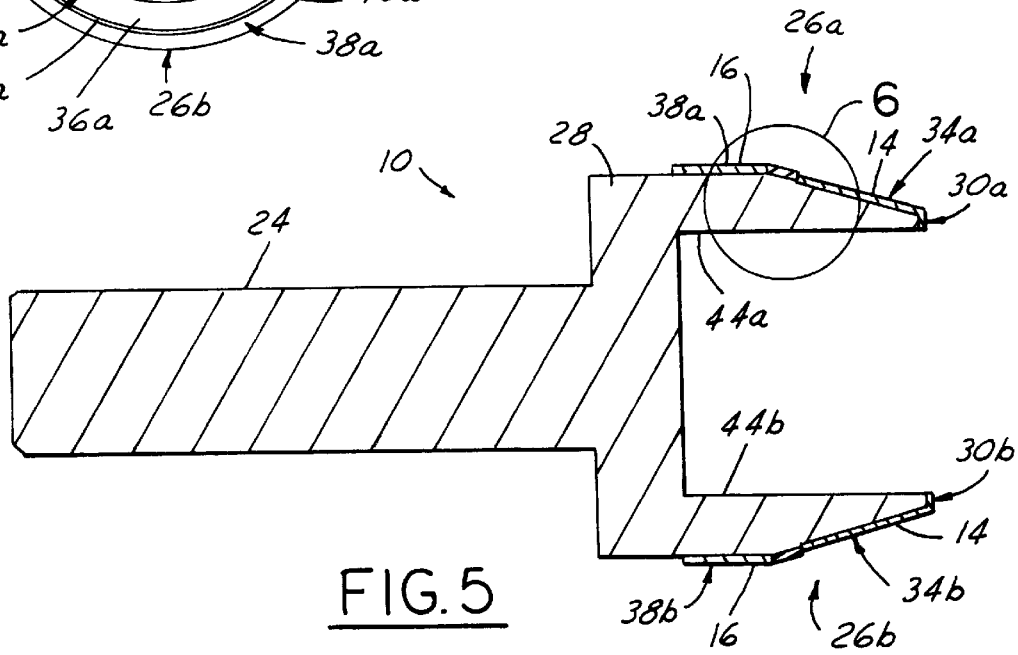
FIG. 5 illustrates a cross-sectional side view of the drill.
Figure 6:
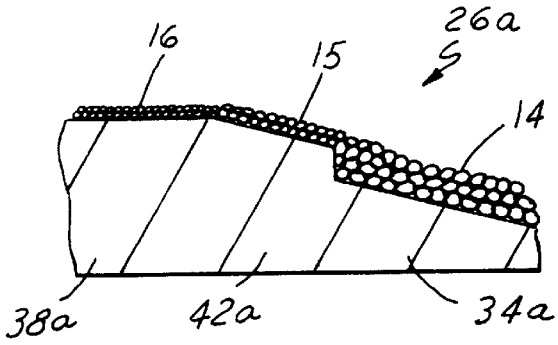
FIG. 6 illustrates in greater detail the circled area shown in FIG. 5.

Referring now to FIGS. 5–6, the diamond grit coating of drill 10 will now be described. FIGS. 5 and 6 are cross-sectional views of drill 10 in which the grades of diamond coating are illustrated with different shadings. The grade of diamond coating which is applied to drill 10 and the axial taper of the specific surface to which it is applied determines the function which is performed by the resulting functional portion of the drill. Specifically, drill 10 has five functional portions: (1) shank 24, (2) cylindrical base 28, (3) reamer 38*a,* (4) grinder 34*a,* and (5) tip 30*a*.

The outer surfaces of tip 30*a,* grinder 34*a,* and reamer 38*a* are abrasive for drilling, enlarging, and finishing a hole being drilled in a fiber reinforced composite material. The abrasive characteristic of the surfaces is preferably accomplished by plating or bonding diamond grit 14 to tip 30*a* and grinder 34*a* and diamond grit 16 to reamer 38*a*.

In the preferred embodiment of the present invention, there are two grades of diamond grit which are bonded to drill 10. They are coarse grit diamond coating 14 and fine grit diamond coating 16. Preferably, coarse grit diamond coating 14 is forty grit diamond coating and fine grit diamond coating 16 is one hundred grit diamond coating. However, as would be apparent to one skilled in the relevant art, any grit diamond coating may be bonded to tip 30*a* and grinder 34*a,* and reamer 38*a,* depending upon the application.

Step 42*a* is used to compensate for differences in thicknesses between coarse grit diamond coating 14 and fine grit diamond coating 16 and generally has a combined coarse/grit diamond coating 15. Use of step 42*a* results in a stepless change from coarse grit diamond coating 14 to fine grit diamond coating 16. Cylindrical base 28 and shank 24 are not diamond coated. Likewise, instep 44*a* of prong 26*a* is not diamond coated.

In the preferred embodiment illustrated in FIGS. 1–6, drill 10 has a diameter of 30 mm. Preferably, the range of the axial taper of tapered cylindrical surface 36*a* of grinder 34*a* is between 10° and 30°. In the preferred embodiment of drill 10, the axial taper of tapered cylindrical surface 36*a* of grinder 34*a* is 15°. The range of values which are provided above have been found by the inventor to include the axial tapers for other embodiments of the present invention having diameters smaller and greater than 30 mm.

Tip 30*a* having coarse grit diamond coating 14 enables drill 10 to quickly initiate and cut a hole. Grinder 34*a* having coarse grit diamond coating 14 grinds the hole to make it become larger. The gradual axial taper of grinder 34*a* allows the grinder to grind the hole to a larger size without causing delamination, fiber breakout, or splintering of the composite material. Following grinder 34*a* with reamer 38*a* having fine grit diamond coating 14 and a desired diameter of a finished hole, enables drill 10 to cleanly finish the hole to the desired size.

Drill 10 is for use with a heavy duty drill capable of providing enough support to keep the drill from wobbling during drilling. The inventor has found that for holes greater than 1 cm, the speed of the drill needs to be at least 2500 revolutions per minute (RPM) and for holes smaller than 1 cm, the speed of the drill needs to be at least 3000 RPM. The inventor has also discovered that the proper feed rate of drill 10 is about 2½ cm per minute and that higher drill speeds may allow for higher feed rates.

Thus it is apparent that there has been provided, in accordance with the present invention, a diamond coated drill for drilling fiber reinforced composite materials that fully satisfies the objects, aims, and advantages set forth above. While the present invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A drill for drilling a hole in a composite material, the drill comprising:

a shank; and a pair of prongs diametrically opposed from one another and extending axially from the shank, each of the prongs having a tip for initiating the hole, each of the prongs further having a grinder disposed axially adjacent to the tip for grinding the hole, each of the grinders having a tapered cylindrical surface axially tapering toward the tip and grinding means on the tapered cylindrical surface, each of the prongs further having a reamer disposed axially between the grinder and the shank for finishing the hole, each of the reamers having a constant diameter cylindrical surface and reaming means on the constant diameter cylindrical surface, wherein each of the prongs further have a tapered cylindrical transition step disposed between the tapered cylindrical surface of the grinder and the constant diameter cylindrical surface of the reamer for providing a step less change between the grinding means and the reaming means.

2. The drill of claim 1 wherein:

the grinding means comprises an abrasive coating bonded to the tapered cylindrical surfaces of the grinders.

3. The drill of claim 2 wherein:

the abrasive coating bonded to the tapered cylindrical surfaces of the grinders is coarse grit diamond.

4. The drill of claim 3 wherein:

the coarse grit diamond is forty grit grade.

5. The drill of claim 1 wherein:

the reaming means comprises an abrasive coating bonded to the constant diameter cylindrical surfaces of the reamers.

6. The drill of claim 5 wherein:

the abrasive coating bonded to the constant diameter cylindrical surfaces of the reamers is fine grit diamond.

7. The drill of claim 6 wherein:

the fine grit diamond is one hundred grit grade.

8. The drill of claim 1 wherein:

the tip includes a semi-elliptical surface extending radially from the shank.

9. The drill of claim 1 wherein:

the shank further includes a cylindrical base for supporting the pair of prongs.

10. The drill of claim 9 wherein:

the cylindrical base has a diameter substantially equal to the diameter of the constant diameter cylindrical surfaces of the reamers.

11. A drill for drilling a hole in a composite material, the drill comprising:

a shank;

a cylindrical base supported on the shank, the cylindrical base having a given circumference; and a pair of prongs diametrically opposed from one another and extending axially from the cylindrical base;

wherein each of the prongs includes a tip for initiating the hole, a grinder for grinding the hole, and a reamer for reaming the hole, the tip having a semi-elliptical surface extending radially from the shank, the grinder disposed axially adjacent to the tip and having a tapered cylindrical surface tapering toward the tip and grinding means on the tapered cylindrical surface, the reamer disposed axially between the grinder and the shank and having a constant diameter cylindrical surface and reaming means on the constant diameter cylindrical surface, wherein each of the prongs further have a tapered cylindrical transition step disposed between the tapered cylindrical surface of the grinder and the constant diameter cylindrical surface of the reamer for providing a step less change between the grinding means and the reaming means.

12. The drill of claim 11 wherein:

the grinding means comprises coarse grit diamond bonded to the tapered cylindrical surfaces of the grinder and the reaming means comprises fine grit diamond bonded to the constant diameter cylindrical surface of the reamer.

13. The drill of claim 11 wherein:

each of the prongs has a circumferential length of one quarter of the given circumference of cylindrical base.

* * * * *